US005372861A

United States Patent [19]

Kerrand et al.

[11] Patent Number: 5,372,861

[45] Date of Patent: Dec. 13, 1994

[54] METHOD OF USING A LASER TO COAT A NOTCH IN A PIECE MADE OF NICKEL ALLOY

[75] Inventors: Emmanuel Kerrand, Villabe; Frédéric Cariou, Paray Vieille Poste; Didier Boucachard, Belfort, all of France

[73] Assignee: European Gas Turbines SA, Paris, France

[21] Appl. No.: 35,186

[22] Filed: Mar. 22, 1993

[30] Foreign Application Priority Data

Mar. 23, 1992 [FR] France ..... 92 03459

[51] Int. Cl.[5] ..... B05D 3/06

[52] U.S. Cl. ..... 427/596; 427/556; 427/597

[58] Field of Search ..... 427/596, 597, 554, 555, 427/556; 219/121.64, 121.66, 121.8

[56] References Cited

U.S. PATENT DOCUMENTS

| | | | |
|---|---|---|---|
| 4,218,494 | 8/1980 | Belmondo et al. | 427/596 |
| 4,269,868 | 5/1981 | Livsey | 427/597 |
| 4,275,124 | 6/1981 | McComas et al. | 427/456 |
| 4,291,448 | 9/1981 | Cretella et al. | 427/456 |
| 4,299,860 | 11/1981 | Schaefer et al. | 427/53.1 |
| 4,644,127 | 2/1987 | La Rocca | 427/596 |
| 4,710,102 | 12/1987 | Ortolano | 416/190 |
| 4,743,733 | 5/1988 | Mehta et al. | 427/597 |
| 4,832,982 | 5/1989 | Mori et al. | 427/53.1 |
| 4,832,993 | 5/1989 | Coulon | 427/596 |
| 5,083,903 | 1/1992 | Erdmann | 416/190 |
| 5,120,197 | 6/1992 | Brooks et al. | 416/191 |
| 5,147,999 | 9/1992 | Dekumbis et al. | 219/121.63 |
| 5,154,581 | 10/1992 | Borufka et al. | 416/190 |

FOREIGN PATENT DOCUMENTS

| | | |
|---|---|---|
| 2642690 | 8/1990 | France . |
| 3509582 | 2/1986 | Germany . |
| 1574984 | 9/1980 | United Kingdom . |

OTHER PUBLICATIONS

Metallurgy and Materials Science Department, Imperial College, London, Great Britain, W. M. Steen: "Laser Surface Cladding", no date.

*Primary Examiner*—Marianne Padgett

*Attorney, Agent, or Firm*—Sughrue, Mion, Zinn, Macpeak & Seas

[57] ABSTRACT

A method of coating a notch in an "upsidedown Z-shape" part of nickel alloy, said notch being constituted by a rounded end wall in the hollow of the "upsidedown Z-shape" followed by a plane wall corresponding to the intermediate portion of the "upsidedown Z-shape" in which a plurality of layers of anti-wear metal material are deposited on said plane wall of the notch. Deposition is performed by a laser whose beam forms a constant angle with the jet of powder. While depositing the first layer the laser beam forms an angle $\alpha_1$ of several tens of degrees with the normal to the plane wall. While depositing subsequent layers the laser beam initially forms an angle $\alpha_3$ close to the normal to the rounded portion before being tilted up to the angle $\alpha_1$, which it then retains throughout the remainder of the pass.

2 Claims, 3 Drawing Sheets

METHOD OF USING A LASER TO COAT A NOTCH IN A PIECE MADE OF NICKEL ALLOY

BACKGROUND OF THE INVENTION

The present invention relates to a method of coating an upsidedown Z-notch in a piece made of nickel alloy, and having a plane wall preceded by a rounded portion. Such pieces may, in particular, be constituted by blades for a gas turbine and be made of a nickel alloy that is difficult to weld.

Mini-plasma and manual TIG methods are much lengthier in use and they depend too much on the operator.

It might be thought that using a method with a very high power laser would enable the layers at the end wall of the notch to be properly bonded, but tests performed have shown that it is not then possible to satisfy the specifications concerning cracking.

SUMMARY OF THE INVENTION

In the method of the invention enabling an anti-wear metal coating to be obtained without cracking and having a good metal bond with the substrate in contact zones of complex shape: a laser beam is used which is capable of being tilted and of being displaced relative to the plane wall of the notch and which makes a fixed angle $\alpha_2$ relative to a jet of powder, the laser beam making an angle $\alpha$ relative to the normal N at the plane wall of the notch, and the powder jet making an angle $\alpha+\alpha_2$ with said normal N; while building up the various layers, a plurality of longitudinal passes are performed at constant speed starting from the end wall of the notch and going towards its edge, the point O where the laser beam and the powder jet meet remaining stationary for a few tenths of a second on the rounded portion of the notch at the beginning of each longitudinal pass; while making the first layer, the angle $\alpha$ remains constant and equal to an angle $\alpha_1$ of less than 30°, whereas while making the following layers the angle $\alpha$ at the beginning of each layer initially takes up a value that is greater than $\alpha_1$ so that the laser beam comes as close as possible to the normal to the rounded portion, after which the laser beam and the powder jet are rotated about the point O at which they meet that remains stationary until the laser beam takes up the angle $\alpha_1$, prior to starting the displacement for making said pass.

Preferably, the point O where the laser beam and the powder jet meet at the beginning of each pass is located in the rounded portion inside the material.

BRIEF DESCRIPTION OF THE DRAWINGS

The invention is described below in greater detail with reference to a particular embodiment given by way of non-limiting example and shown in the accompanying drawings.

MORE DETAILED DESCRIPTION

Figure 1:
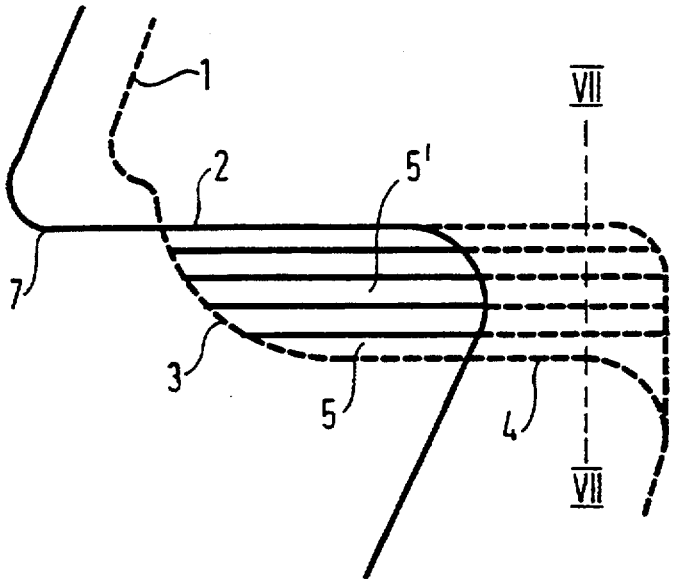
FIG. 1 shows a part provided with a coating before and after machining.

The raw profile 1 of the nickel alloy blade is shown in dashed lines in FIG. 1. This outline is of the "upsidedown Z-shape" and in the intermediate portion of the "upsidedown Z-shape" it includes a notch 2 constituted by a rounded portion 3 followed by a plane portion 4 corresponding to the intermediate portion of the "upsidedown Z-shape".

The notch 2 is coated with a plurality of plane layers 5 and 5' parallel to the plane portion 4 by means of a $CO_2$ laser with metal powder being projected into the beam of the laser.

Figure 7:
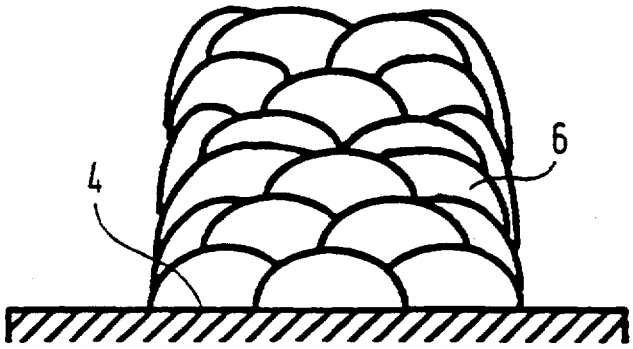
FIG. 7 is a section through FIG. 1.

Each layer 5 is made up of a plurality of adjacent fillets 6 laid during successive passes (see FIG. 7).

The deposit is constituted by an anti-wear metal coating that does not crack and that provides good metal bonding with the nickel alloy substrate.

The entire Z-shape is machined again to obtain the final profile 7 shown by the solid line in FIG. 1.

The laser beam 8 can be tilted and displaced relative to the plane wall 4 of the notch 2. The direction of the laser beam and the direction 9 along which powder is projected form a constant angle $\alpha_2$ (see FIG. 2).

Given the complex shape of the part and the confinement of the zone to be treated, the laser beam 8 is inclined relative to the normal N to the plane wall 4 of the notch 2 through an angle $\alpha$ of several tens of degrees. This angle depends on the profile of the blade.

The angle is selected to be as small as possible, i.e. so that the beam 8 practically coincides with or is close to a line parallel to the plane of the first branch 10 of the "upsidedown Z-shape".

Thus, the beam 8 makes an angle $\alpha$ with the normal N and the direction 9 along which powder is projected is at an angle $\alpha+\alpha_2$.

Figure 2:
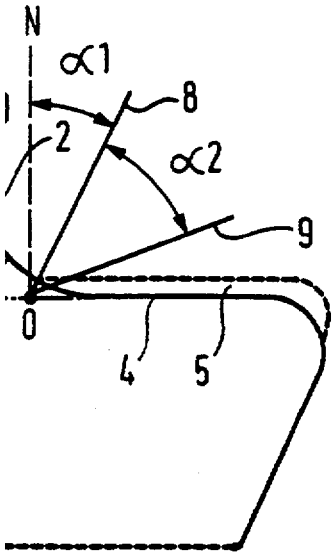
FIG. 2 shows the first layer being deposited on the rounded portion of the notch.
Figure 3:
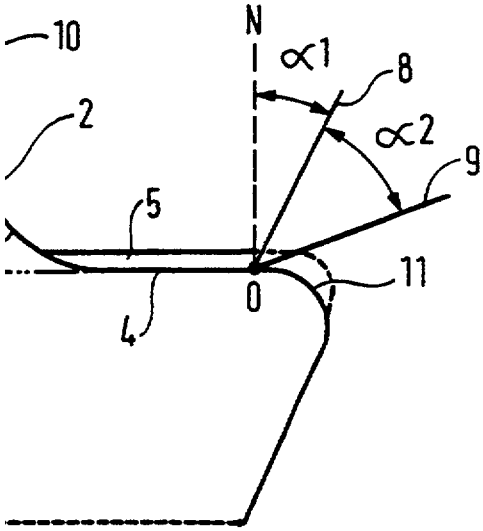
FIG. 3 shows the first layer being deposited on the plane face of the notch.

Making the first layer (see FIGS. 2 and 3). The angle of inclination of the laser beam 8 is set to $\alpha_1$ and it is not changed throughout the entire time required for making the first layer 5. In one particular example, $\alpha_1$ was equal to 25°, and was substantially parallel to the first branch 10 of the "upsidedown Z-shape".

The point of intersection 0 between the laser beam 8 and the powder jet 9 is positioned on the rounded end wall 3 of the notch 2 within the material (a few tenths of a millimeter), thereby making it possible firstly to accommodate the difference in height relative to the main portion 4 of the zone to be covered and thus to avoid any subsequent modification in the positioning thereof when performing the current pass, and secondly to keep the jet of powder 9 downstream from the point of contact between the laser beam and the part in order to ensure better melting of the powder and to minimize projection of particles towards the end wall of the notch 2 (FIG. 2).

In addition, the point of intersection O is kept inside the material for a few tenths of a second without displacement in order to increase the laser/material interaction time and to cause the substrate to melt.

The combined laser beam 8 and powder jet 9 (constant angle $\alpha_2$) is then displaced at constant speed to the edge 11 of the "upsidedown Z-shape", with the beam/powder intersection point lying on the surface of the substrate (FIG. 3).

The operation is then repeated until the first layer 5 has been deposited.

Figure 4:
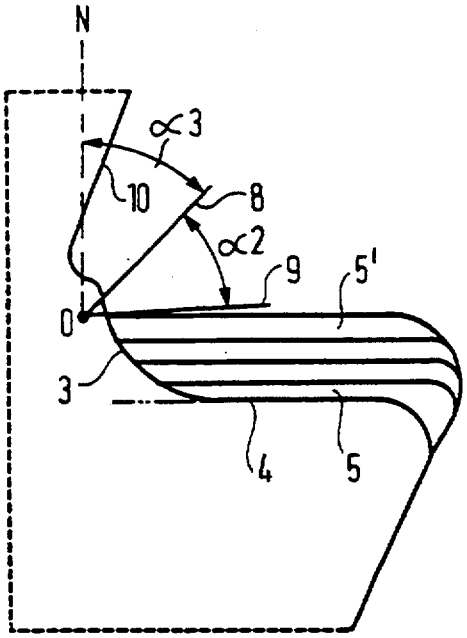
FIG. 4 shows the first stage of depositing a subsequent layer on the rounded portion of the notch.
Figure 5:
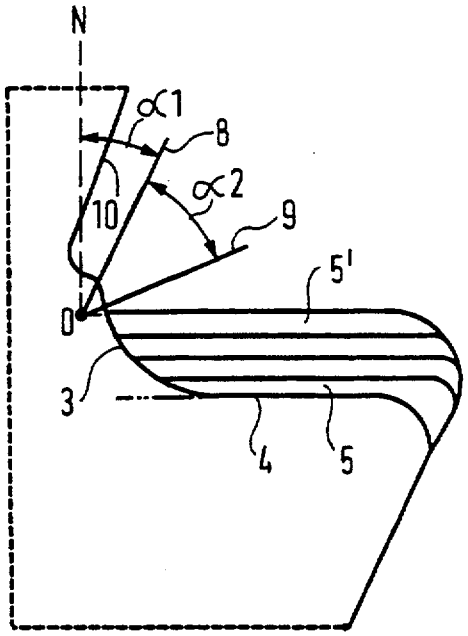
FIG. 5 shows the second deposition stage after FIG. 4.
Figure 6:
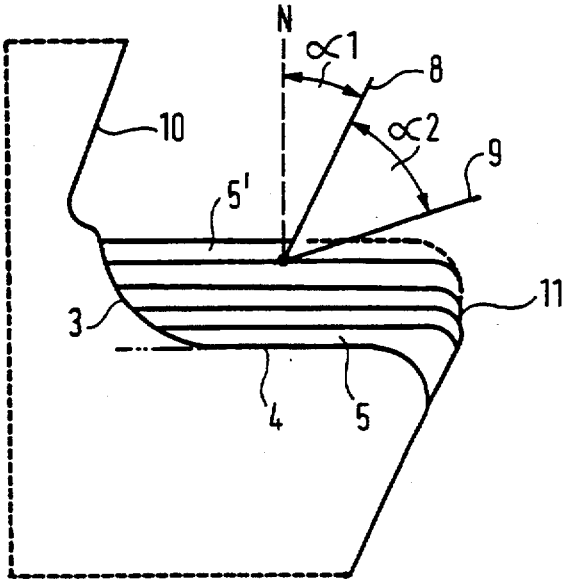
FIG. 6 shows the layer of FIGS. 4 and 5 being deposited on the plane face of the notch.

Then the subsequent layers are formed (FIGS. 4 to 6). In order to apply a new layer 5' (fifth layer in FIG. 4), the laser beam 8 is inclined relative to the normal N through an angle $\alpha_3$ which is as close to the possible normal N to the rounded portion 3, thereby enabling the laser beam 8 to be better absorbed by the material: naturally it is necessary for the powder jet 9 (inclined at $\alpha_2$ where $\alpha_2$ is constant and $10° \leqq \alpha_2 \leqq 20°$) to be above the plane wall 4, which puts an upper limit on the angle $\alpha_3$.

The angle $\alpha_3$ is thus different from one layer to another.

As for the first layer 5, the beam/powder intersection point O lies inside the material of the rounded portion. The combined laser beam and powder jet 8, 9 is then tilted about this point within a few tenths of a second ($<1$ s) in order to increase the interaction time and replace the laser beam 8 in a position suitable for building a new pass.

The laser beam 8 is then at an angle $\alpha_1$ to the normal N, and it is displaced as during deposition of the first layer 5 with $\alpha_1$ and $\alpha_2$ remains constant going from the end wall 3 of the notch 2 towards the edge 11, while remaining on the surface of the previously deposited layer (see FIG. 6). Each pass begins again from the end wall 3 using a laser beam 8 at an angle $\alpha_3$ (which remains the same for any given layer) before tilting up the beam 8 to an angle $\alpha_1$ and then displacing it towards the edge so that the laser beam 8 remains inclined at a constant angle $\alpha_1$.

The coating deposited in this way has the appearance shown in FIG. 7, where its various layers 5, 5' are built up from fillets 12 made during respective passes.

The "upsidedown Z-shape" part is subsequently machined again (FIG. 1).

We claim:

1. A method of coating a Z-notch in a part of nickel alloy, said notch comprising a rounded end wall in a hollow thereof followed by a plane wall, in which method a plurality of layers of anti-wear metal material are deposited on the plane wall of the notch, wherein:

a laser beam is used which is capable of being tilted and of being displaced relative to the plane wall of the notch and which makes a fixed angle $\alpha_2$ relative to a jet of powder, the laser beam making an angle $\alpha$ of positive value relative to the normal N at the plane wall of the notch, and the powder jet making an angle $\alpha+\alpha_2$ with said normal N, said angles $\alpha$ and $\alpha_2$ being in a common plane;

while building up various layers, a plurality of longitudinal passes are made at constant speed starting from an inner wall of the notch and going towards an outer edge of said plane wall, a point O of intersection of the laser beam and the powder jet remaining stationary for a few tenths of a second on the rounded end wall of the notch at the beginning of each longitudinal pass; and while making a first coating layer, the angle $\alpha$ remaining constant and equal to a positive angle $\alpha_1$ of less than 30°, whereas while making each of the following layers, the angle $\alpha$ at the beginning of each following layer initially takes up a value that is greater than $\alpha_1$ so that the laser beam comes as close as possible to the normal to the rounded end wall, after which the laser beam and the powder jet are rotated about the point O which remains stationary until the laser beam takes up the angle $\alpha_1$ prior to starting a displacement for making a next longitudinal pass.

2. A method according to claim 1, wherein the point O where the laser beam and the powder jet meet at the beginning of each pass is located inside the material of the rounded end wall and at a surface of said part during the remainder of each pass.

* * * * *